United States Patent [19]

Fujii et al.

[11] Patent Number: 4,573,061

[45] Date of Patent: Feb. 25, 1986

[54] IMAGE RECORDING APPARATUS

[75] Inventors: Haruo Fujii, Yokohama; Yuji Sakemi, Kawasaki; Tsutomu Toyono, Yokohama, all of Japan

[73] Assignee: Canon Kabushiki Kaisha, Tokyo, Japan

[21] Appl. No.: 610,486

[22] Filed: May 15, 1984

[30] Foreign Application Priority Data

May 18, 1983 [JP] Japan ..... 58-87329
Apr. 28, 1984 [JP] Japan ..... 59-86892

[51] Int. Cl.[4] ..... B41J 3/18
[52] U.S. Cl. ..... 346/153.1; 346/155
[58] Field of Search ..... 346/155, 139 C, 153.1

[56] References Cited

U.S. PATENT DOCUMENTS 4,390,887 6/1983 Chynoweth et al. ..... 346/155
4,502,061 2/1985 Ando et al. ..... 346/153.1

FOREIGN PATENT DOCUMENTS 118040 10/1978 Japan ..... 346/155

*Primary Examiner*—E. A. Goldberg
*Assistant Examiner*—A. Evans
*Attorney, Agent, or Firm*—Fitzpatrick, Cella, Harper & Scinto

[57] ABSTRACT

An image recording apparatus includes a recording electrode having an array of electrode elements which are electrically isolated, a recording material on which an image is recorded, a driving mechanism for moving the recording material while it is opposed to the recording electrode, a magnet for generating a magnetic field across the clearance between the recording electrode and the recording material, a toner supply device for supplying the toner to the clearance, and a device for applying an imagewise voltage signal between the recording electrode and the recording material, wherein the electrode elements each have an end portion converged toward the recording material.

5 Claims, 7 Drawing Figures

IMAGE RECORDING APPARATUS

BACKGROUND OF THE INVENTION

1. Field of the Invention

The present invention relates to an image recording apparatus, more particularly to an apparatus wherein one-component, conductive and magnetic developer (hereinafter simply called a "toner") is imagewisely deposited on a recording material directly in response to electric image signals.

2. Description of the Prior Art

An image recording apparatus of this type is known, as disclosed in U.S. Pat. No. 3,816,840, which will be briefly described with FIG. 1. The apparatus comprises a toner container 2 and a stationary toner carrying member 1 which is dipped in the powder of conductive and magnetic toner T. The toner carrying member is in the form of a cylinder of non-magnetic material. In carrying member 1, there is a magnet 3, as magnetic field generating means, which is rotatable in the direction of arrow A and which has magnetic poles of opposite polarities equidistantly spaced around the circumference thereof. A recording electrode assembly 4 is provided, including an array of electrode elements which are electrically isolated from each other and extended on the surface of the toner carrying member along the axis thereof. The electrode elements are made of a conductive and magnetic material, such as permalloy, nickel and iron. Opposed to the recording electrode 4, a recording material 5 is moved in the direction of arrow B. The recording material is shown as consisting of a conductive base plate 5*a* and a dielectric layer 5*b* thereon, but not limited to this type. Commercially available electrostatic recording paper is usable.

Across the recording material 5 from the recording electrode 4, there is provided a backing roller electrode 6 which is in contact with the conductive base plate 5*a* of the recording material 5. The apparatus further comprises a doctor blade 7 and an image signal source 9. The reference numeral 8 designates a recording station where the recording is effected.

In operation, the magnet 3 is rotated in the direction of the arrow A, while the recording material 5 is moved in the direction of the arrow B, by unshown conventional driving mechanisms. The rotation of the magnet 3 moves the toner on the carrying member 1 by the function of the magnetic field thereof in the direction shown by arrow A'. The toner T, while being moved thereon, is subjected to a regulating function of the doctor blade 7 secured to the container 2 at its outlet so that the toner is formed into a thin layer of uniform thickness. Thereafter, the toner T is conveyed to the recordihg station 8, whereat the tips of the recording electrodes are opposed to the backing electrode 6, and they are erected in the form of chains on the tips of the recording electrode so as to contact the surface of the recording material 5. In this state, upon a signal voltage applied between the electordes 4 and 6 from the signal source, the electric charge injected into the toner particle, which is on the surface of the recording material 5, through the chain of the toner particle, is electrostatically attracted by the electric charge injected to the neighborhood of the back of the dielectric layer 5*b*, so that the toner is held on the surface of the dielectric layer 5*b* of the recording material 5. This forms an image in accordance with the image signal. The resultant image is heat-fixed or pressure-fixed on the recording material 5 by an unshown fixing device.

Referring now to FIG. 2, another conventional image recording apparatus is shown, such as those known by U.S. application Ser. No. 22859. Since this is similar to the system described with FIG. 1, except for the portions which will be described, the detailed description of the similar parts is omitted for the sake of simplicity by assigning the same reference numerals are assigned to the elements having the corresponding functions.

A recording material 5 is a cylinder having a conductive base plate 5*a* and a dielectric layer 5*b* thereon. It is rotatable in the direction of arrow Z. In a toner container 12, there is powder of toner T into which a stationary toner applying roller of a non-magnetic material is dipped. In the toner applying roller, there is a rotatable magnet 11 which is driven by an unshown driving mechanism. A recording electrode assembly 4 includes a number of electrode elements opposed to the recording material 5. The electrode elements are made of a conductive and magnetic material. The electrode 4 is sandwiched by magnets 15 having opposing N poles and outside S poles, for example.

When the magnet 11 rotates in the direction of arrow C, the conductive magnetic toner T moves from the container 12 on the applying roller 10 in the direction of arrow D and is subjected to a regulating function of a doctor blade 7 to become a thin layer, which is conveyed toward the recording material 3. Between the recording material 5 and the toner applying roller 10, a voltage is applied by the power source 13, so that the toner T is attached to the recording material surface by electrostatic force to form a thin layer thereon. The thin coated toner layer is conveyed, by the rotation of the recording material 5, to the recording station 8, at which the toner particles are formed into chains extending to reach to the tips of the recording electrode 4. The contact of the toner to the electrode 4 discharge the charge having been injected by the applying roller 10 through the chains of the toner particles and the recording electrode 4, so that there is now no attracting force between the recording material 5 and the toner T. At this instance, if an imagewise signal voltage is applied between the recording material 5 and the recording electrode 4 from the signal source 9, an electric charge appears in the surface toner through the chains of the toner particles, as explained with respect to FIG. 1. The electric charge cooperates with the charge at the back of the dielectric layer 5*b* to hold the toner T on the recording material 5. Then, the unattached toner T is removed, without disturbing the imagewisely attached toner T, by a toner remover 14, such as those using a magnetic attraction or air flow to leave the attached toner T. By doing so, a visualized image appears.

However, it has been found by the inventors that those conventional systems involve a problem from the standpoint of high resolution image. The problem is that, if the spacing between the adjacent electrode elements is reduced in order to enhance the resolution, the distance between the recording electrode 4 and the recording material must also be reduced, correspondingly. This makes it difficult to embody the system.

SUMMARY OF THE INVENTION

Accordingly, it is a principal object of the present invention to provide an image recording apparatus, wherein a sharp image can be recorded.

It is another object of the present invention to provide an image recording apparatus, wherein a high density image can be formed.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENT

Now, the present invention will be described in comparison with the prior art and in conjunction with the accompanying drawings.

Figure 1:
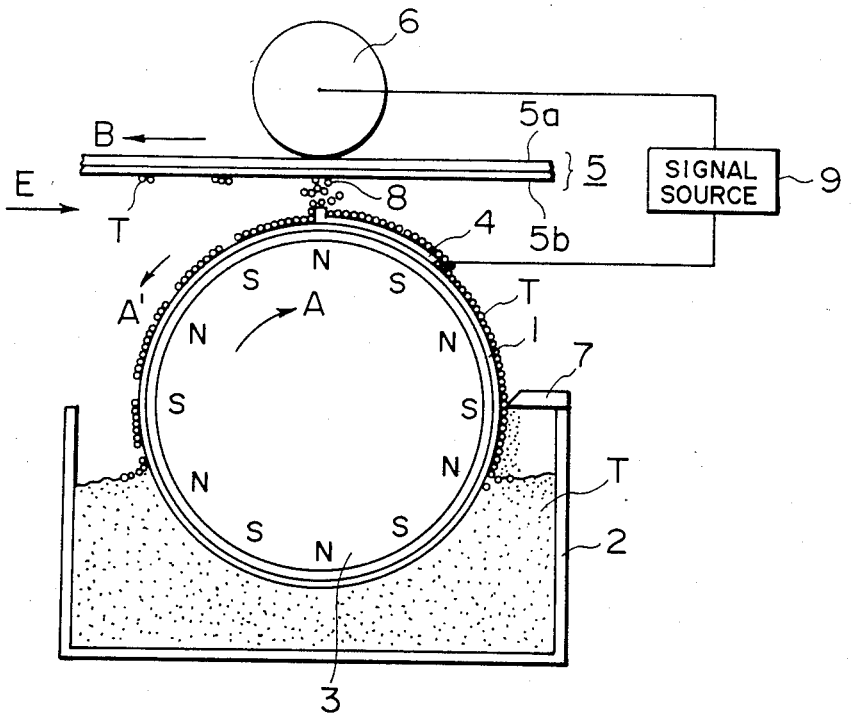
FIG. 1 PRIOR ART
FIG. 1 is a cross-sectional view of a recording apparatus of prior art.
Figure 2:
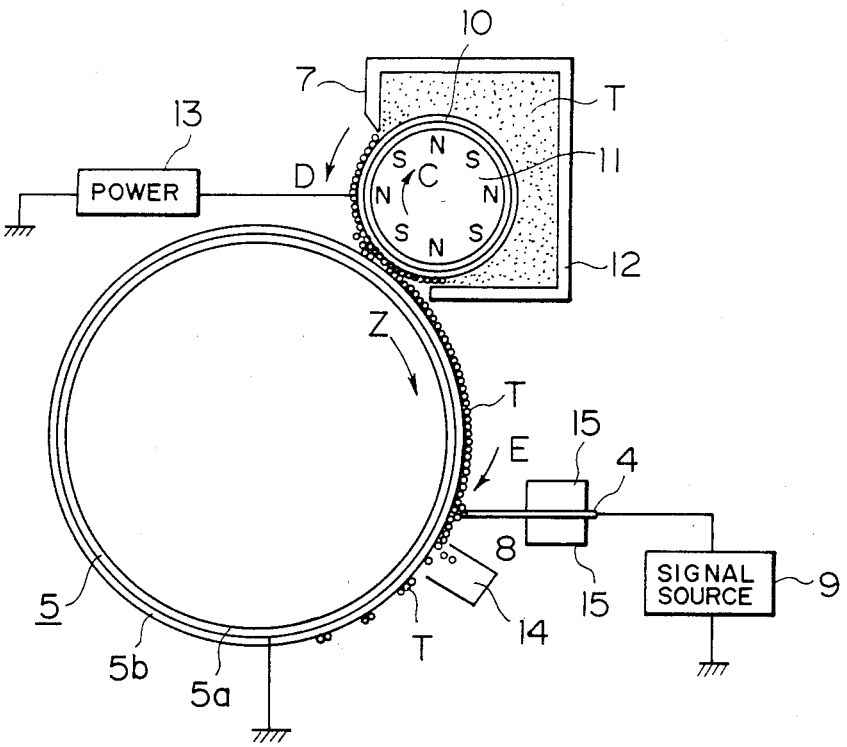
FIG. 2 PRIOR ART
FIG. 2 is a cross-sectional view of another recording apparatus of the prior art.
Figure 3:
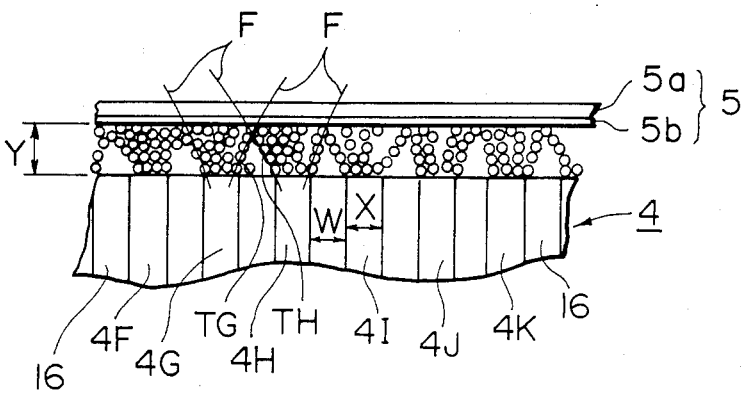
FIG. 3 is an illustration of extension of toner particles.

FIG. 3 illustrates what have been found by the inventors as a result of experiments made with respect to a prior art device. It is an enlarged cross-section seen in the direction of arrow E in FIGS. 1 and 2. The electrode 4 used with the experiments was made by forming a nickel film as a magnetic material on a polyimide resin film as an insulating material, and etching the nickel film. The electrode 4 may be made by other methods, for example, by forming a copper film on a polyimide resin film, etching the copper layer and plating it with a magnetic material such as nickel or permalloy, or may be made by forming a rows of fine permalloy wires and binding them with epoxy resin. As for the toner, VQC imaging powder TYPE 355 available from M.M.M. This is a conductive magnetic toner of 10 and several μm particle size. A toner having 5–100 μm particle size is usable. As to the recording density, 10 electrode elements are arranged in 1 mm. The element has the width X which is the same as the spacing W from the adjacent ones, so that the width X and spacing W are equal to 50 μm.

As shown in FIG. 3, the chains or ears of the toner particles diverge toward the recording material 5 along lines F to such an extent that chains $T_G$ and $T_H$ extending from adjacent electrode elements 4G and 4H are superimposed adjacent to the recording material 5. Therefore, in the case where the electrode element 4G is supplied with a signal voltage while the electrode element 4H is not, the chains of toner $T_G$ and $T_H$ are electrically short-circuited, or a sufficient amount of toner is not deposited on the recording material 5, or unwanted toner is deposited thereon, with the result of blurred image with unsharp boundary. It will reasonably be thought that this problem can be solved by approaching the recording material 5 to the electrode 4. Practically, however, it is difficult to maintain a close spacing between the recording medium 5 and the recording electrode 4 over the entire area.

Table 1 shows results of the experiments as to the needed relation between the spacing W of electrode elements 4 and the clearance between the element 4 and the recording material 5 to obtain high quality image.

TABLE 1

| Spacing W between electrode elements (μm) | Clearance between electrode and recording material (μm) |
|---|---|
| 25 | 62 |
| 50 | 125 |
| 75 | 187 |
| 100 | 250 |

As will be readily understood from Table 1, the clearance Y has to be not more than 2.5 times spacing W.

Thus, the conventional image recording apparatus involves the drawback that, if the spacing between adjacent electrode elements is reduced in order to obtain the higher density of the image, the clearance between the recording electrode 4 and the recording material 5 has to also be reduced, which results in difficulties in manufacturing the apparatus.

This drawback has been eliminated by the present invention in which the end of the electrode element is made converge toward the recording material 5. This is effective to avoid the superimposing between the adjacent chains of toner particles.

Figure 4:
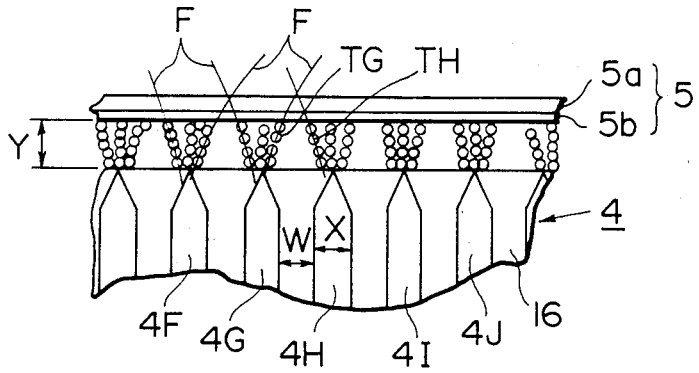
FIG. 4 is an illustration of extension of the toner particles in an apparatus according to an embodiment of the present invention.

FIG. 4 illustrates an embodiment of the present invention, wherein the elements having the same function as the corresponding elements of FIG. 3 are given the same reference numerals. FIG. 4 is an enlarged cross-section seen in the direction of arrow E in FIGS. 1 and 2. What is different from FIG. 3 is that the electrode element 4 is pointed at the tip. As shown in FIG. 4, the electrode elements 4F, 4G, 4H, 4I or 4J have the width X of 50 μm, and cut straight, by etching from the position 25 μm away from the end toward the tip end, at which it has 1 μm width. By this, the chains $T_G$ and $T_H$ of the toner are separated on the recording material 5, even if the clearance between the electrode 4 and the recording material 5 is made greater than 2.5 times the spacing W. Therefore, the clearance between the electrode 4 and the recording material 5 can be increased, while maintaining the image quality higher than the conventional. This makes the manufacturing of the apparatus easier. On the contrary, if the clearance between the recording material 5 and the recording element 4 is the same, the spacing 4 between adjacent electrode elements 4 can be reduced so that the image density can be increased.

In this embodiment, the high density of 20 points per 1 mm, was made possible with the clearance of 100μ between the recording electrode 4 and the recording material 5.

The foregoing embodiment has been described as employing the electrode 4 manufactured by etching. However, when the electrode elements are made of wires, the ends thereof may be pointed with the same effects. Also, the above embodiment has been described as having the electrode elements provided with the points formed by straight cutting. The configuration of the pointing may be in another form, if the element is converged toward the recording material.

Figure 5:
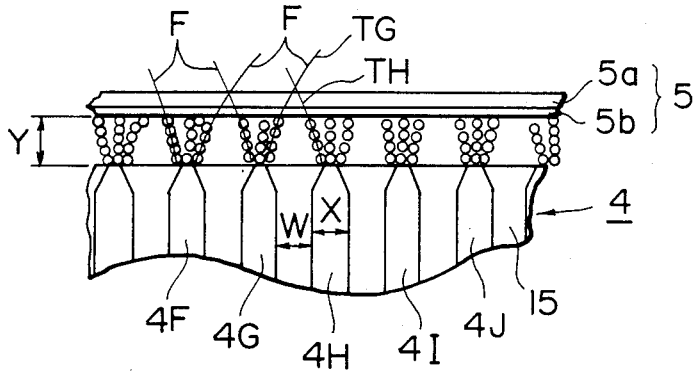
FIG. 5 is an illustration of extension of the toner particles in an apparatus according to another embodiment of the present invention.

FIG. 5 shows another embodiment of the present invention, wherein the tip of the electrode element is cut out by 10 μm from the pointed tip to provide the tip width of 20 μm, so as to ensure the contact of the base of the toner chain with the end of the electrode element. This configuration causes the magnetic field provided by the magnet 15 to extend through the electrode element 4 to sufficient extent, as well as the sure contact with the toner to take place, thus making possible a sharp image without foggy background.

Figure 6A:
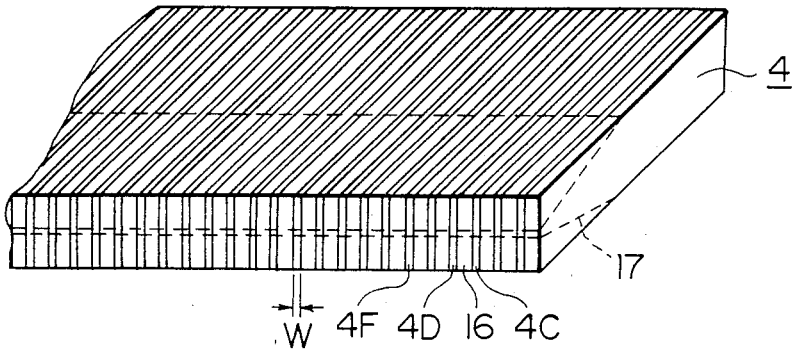
FIGS. 6A and 6B are a schematic perspective views of a part of an apparatus according to a further embodiment of the present invention.
Figure 6B:
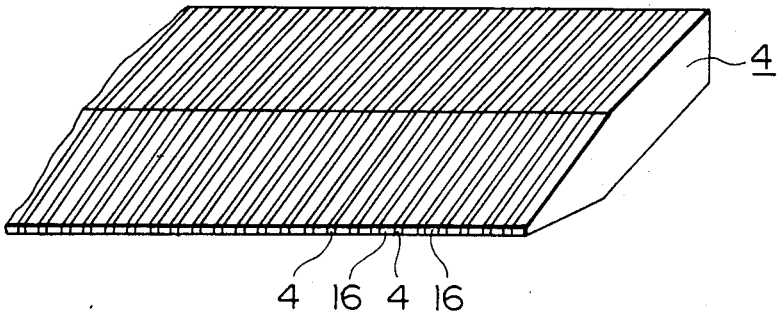

FIG. 6A illustrates a further embodiment of the present invention, wherein permalloy films of 5 mm thickness, 20 μm width and 50 mm length are arranged parallel as the electorde elements. Between the electrode elements, i.g., elements 4C and 4D, a polyimide resin film of 30 μm, as a dielectric layer 16 is attached by the bonding layers of 5 μm thickness at the both sides. The laminated structure manufactured in this manner is cut inclinedly from the position 7 mm away from the end so that the thickness at the tip is approx. 20 μm. FIG. 6B is a perspective view showing the product by the above steps.

According to this embodiment, the recording electrode assembly with high density is easily manufactured, which allows the magnetic field of the magnet 15 to extend therethrough to a sufficient extent, as in FIG. 5 embodiment, so that a sharp image can be provided without discontinuation in an image pattern.

The electrode assembly manufactured in the above described manner is preferably be coated with an insulating material at its top and bottom surfaces with the exception of the tip ends, since then the possibility of the short-circuiting the adjacent electrodes, by foreign matter or toner particles can be prevented.

The tip of the element may have the width of 1 μm as in FIG. 5 embodiment. However, for the reasons described hereinbefore, the width of the present embodiment is preferable.

In the foregoing embodiments, the magnetic field generating means is provided at the recording electrode side. However, it is a possible alternative that the magnetic field generating means is located at the back of the recording material 5 to sandwich the recording material 5 by the magnetic field generating means and the recording electrode, whereby the toner is supplied to the recording electrode.

As described above, according to the present invention, the tip of the electrode element of this type image recording material is pointed to make it possible to reduce the width and/or thickness of the electrode element, so that the electrode array can be made at a higher density and that the manufacturing is made easier.

While the invention has been described with reference to the structures disclosed herein, it is not confined to the details set forth and this application is intended to cover such modifications or changes as may come within the purpose of the improvements or the scope of the following claims.

What is claimed is:

1. An image recording apparatus, comprising:

a recording electrode having an array of magnetic electrode elements which are electrically isolated;

a recording material;

means for causing relative movement between said recording electrode and said recording material while they are closely opposed to each other;

means for applying magnetic tone particles to a clearance between the recording electrode and the recording material;

means for generating a magnetic field across the clearance between the recording electrode and the recording material to form a chain of magnetic tone particles between the recording material and a leading edge of each of the magnetic electrode elements; and means for applying and imagewise voltage signal between said recording electrode and said recording material, wherein said electrode elements each have an end portion which is so converged toward said recording material that a clearance, measured along the array, between adjacent electrode elements is larger adjacent the end portions than the other portions.

2. An apparatus according to claim 1, wherein the clearance between the recording electrode and the recording material is larger than 2.5 times the spacing between said other portions of said adjacent electrode elements.

3. An apparatus according to claim 1, wherein the toner particles are electrically conductive.

4. An apparatus according to claim 1, wherein the electrode elements are manufactured by an etching method.

5. An apparatus according to claim 1, wherein the tip of each electrode element is pointed.

* * * * *

UNITED STATES PATENT AND TRADEMARK OFFICE

CERTIFICATE OF CORRECTION

PATENT NO. : 4,573,061

DATED : February 25, 1986

INVENTOR(S) : Fujii et al.

It is certified that error appears in the above-identified patent and that said Letters Patent is hereby corrected as shown below:

Column 1, line 9, change "imagewisely" to --imagewise--;
lines 19-20, change "In carrying" to --In the carrying--;
line 54, change "recordihg" to --recording--; and
line 60, change "electordes" to --electrodes--.

Column 2, line 9, change "by assigning" to --and--;
line 38, change "discharge" to --discharges--;
line 52, change "imagewisely" to --imagewise--; and
line 58, change "high resolution" to --high-resolution--.

Column 3, lines 2-3, change "high density" to --high-density--;
line 12, change "of prior art" to --of the prior art--; and
line 44, change "rows" to --row--.

Column 4, line 6, change "high quality image." to --a high-quality image.--; and
line 27, change "made converge" to --made to converge--.

UNITED STATES PATENT AND TRADEMARK OFFICE

CERTIFICATE OF CORRECTION

PATENT NO. : 4,573,061

DATED : February 25, 1986

INVENTOR(S) : Fujii, et al.

It is certified that error appears in the above-identified patent and that said Letters Patent is hereby corrected as shown below:

Column 5, line 12, change "the electorde elements." to --the electrode elements.--;
line 13, change "i.g.," to --e.g.,--;
line 27, change "above described" to --above-described--; and
line 28, change "preferably be coated" to --preferably coated--.

Column 6, line 27, change "and" to --an--.

Signed and Sealed this

Twentieth Day of January, 1987

*Attest:*

*Attesting Officer*

DONALD J. QUIGG

*Commissioner of Patents and Trademarks*